US007237447B2

(12) United States Patent
Cilibraise

(10) Patent No.: US 7,237,447 B2
(45) Date of Patent: Jul. 3, 2007

(54) ENGINE START/STOP SYSTEM

(75) Inventor: Gerald Cilibraise, Livonia, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 641 days.

(21) Appl. No.: 10/742,096

(22) Filed: Dec. 19, 2003

(65) Prior Publication Data

US 2005/0132828 A1 Jun. 23, 2005

(51) Int. Cl.
*F02N 1/00* (2006.01)

(52) U.S. Cl. ..... 74/7 E; 474/134

(58) Field of Classification Search ..... 74/6, 74/7 R, 7 E; 474/134
See application file for complete search history.

(56) References Cited

U.S. PATENT DOCUMENTS 5,591,094 A 1/1997 Farmer et al.
5,857,380 A * 1/1999 Kajino et al. ..... 74/7 E
6,592,482 B2 7/2003 Serkh
6,595,883 B1 7/2003 Breed et al.
6,609,988 B1 8/2003 Liu et al.
6,652,401 B2 11/2003 Liu
6,910,453 B2 * 6/2005 Sugino et al. ..... 123/179.28
2004/0173174 A1 * 9/2004 Sugino et al. ..... 123/179.28
2005/0126318 A1 * 6/2005 Xue et al. ..... 74/7 E
2005/0132828 A1 * 6/2005 Cilibraise ..... 74/7 E

* cited by examiner

*Primary Examiner*—David M. Fenstermacher
(74) *Attorney, Agent, or Firm*—Ralph E. Smith

(57) ABSTRACT

An arrangement for starting an engine includes a torque coupler provided between a starter motor and the engine crankshaft. The torque coupler includes a gear mechanism arranged to allow a starter motor to rotate for a period of time prior to transferring rotational torque to the crankshaft to turn the engine over.

21 Claims, 3 Drawing Sheets

ENGINE START/STOP SYSTEM

FIELD OF THE INVENTION

The present invention relates to starter systems for motors, and more particularly, to an improved starter system operable to rapidly start a motor.

BACKGROUND OF THE INVENTION

Conventional engine systems commonly include a starter motor, a flywheel, and a vehicle engine. Responsive to operation of an ignition switch, the starter motor is operable to deliver a force directly to the flywheel of the engine to rotate the flywheel and start the engine.

While such systems adequately start a vehicle engine, they do not facilitate continual starting and stopping of the vehicle engine because the torque required by the starter motor to rotate the flywheel and start the engine cannot be rapidly generated. In this manner, conventional systems require vehicles to remain running when temporarily stopped such as at traffic lights and railroad crossings.

Further, while use of a larger starter motor may provide sufficient torque to rapidly and start a vehicle engine on demand, and may significantly reduce disparity in gear ration between the starter motor and flywheel, a larger starter motor typically creates packaging issues within an engine compartment of a vehicle. In addition, implementing a larger starter motor likely requires replacing a standard 12-volt vehicle battery/electrical system with a larger and more expensive 42-volt vehicle battery/electrical system to handle the electrical requirements of the larger starter motor.

Therefore, a need exists for a starter system arrangement that facilitates rapid and repeated starting (on-demand) of a vehicle engine when a vehicle is temporarily stopped. Additionally, such a starter system capable of operating with a conventional 12-volt vehicle battery is also desirable.

SUMMARY OF THE INVENTION

Accordingly, the present invention provides an apparatus for improving engine starting wherein the apparatus includes a gearing arrangement in a torque transfer element arranged to momentarily delay driving of an output connected to an engine crankshaft, thereby allowing the torque transfer element to attain maximum rotation speed when driven by an engine starter motor before engine load is applied thereto. In this manner, the present invention provides a kinetic energy accumulator or "storage" arrangement in the torque transfer element operable to allow the output shaft of the starter motor to rotate up to speed for a predetermined period of time prior to transfer of rotational torque to the output.

In another aspect of the invention, a method for starting an engine is provided and includes providing a starter motor having an output shaft and a planetary gear set driven by the output shaft of the starter motor, rotating the starter motor to accumulate kinetic energy without concurrently driving an output of the planetary gear set, transferring the kinetic energy from the starter motor to the output of the planetary gear set once maximum or desired kinetic energy is achieved, such that the output of the planetary gear set is driven at a reduced rotational speed, and finally, fixing the output of the planetary gear set to a crankshaft of the engine and rotating the crankshaft in response to rotation of the output of the planetary gear set to thereby start the engine.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
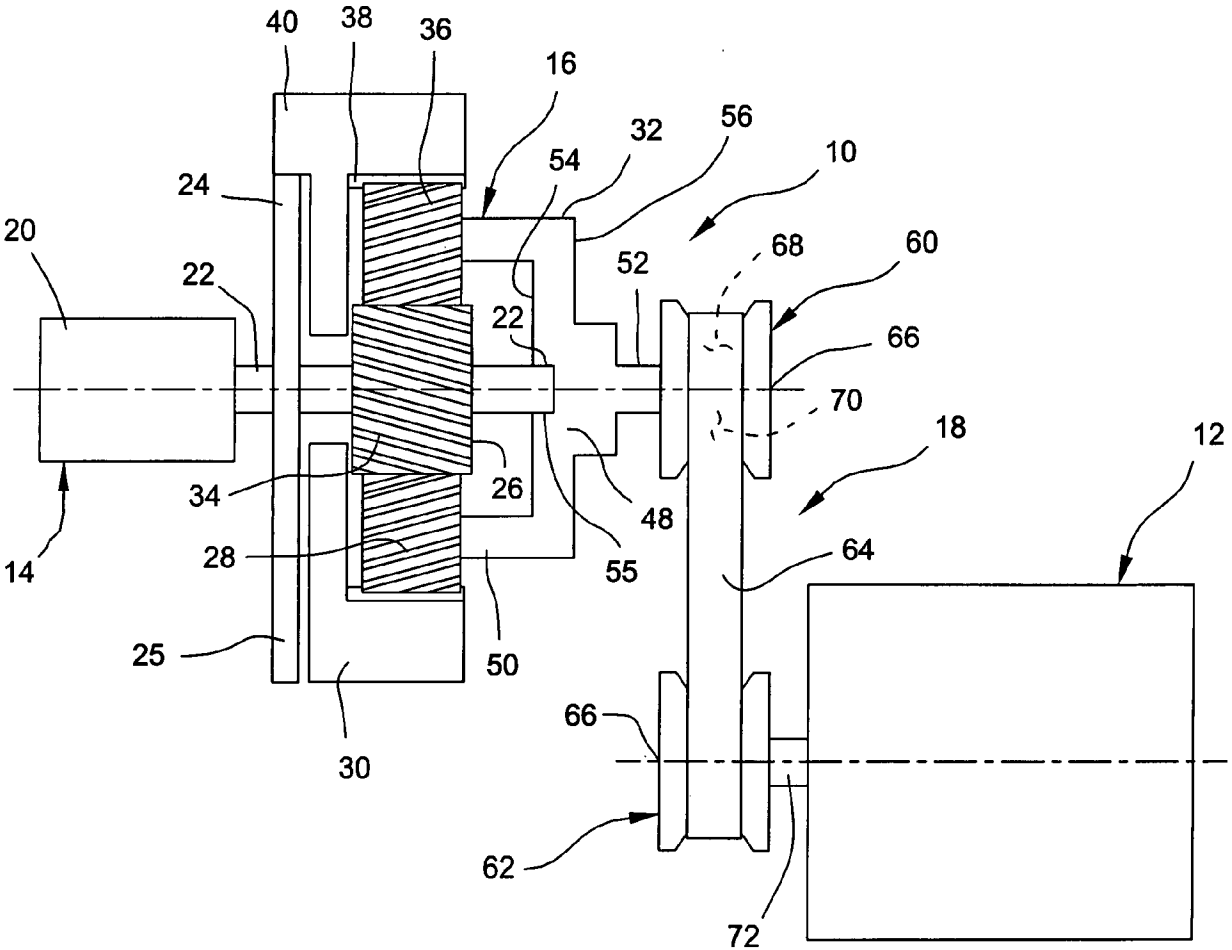
FIG. 1 is a sectional view of a starter system shown operably attached to a vehicle engine.

With reference to the figures, a starter system 10 for use with a vehicle engine 12 is provided and includes a starter motor 14 (in the exemplary embodiment the starter motor is arranged to operate in a conventional 12-volt vehicle electrical system), a torque coupler element including a planetary gear set 16, and a pulley assembly 18. The starter motor 14 is operable to rotate the planetary gear set 16 in response to an external signal. The planetary gear set 16 is operable to permit the starter motor 14 to accumulate sufficient kinetic energy prior to transmitting a rotational force to the pulley assembly 18 and vehicle engine 12. In this manner, the planetary gear set 16 is operable to allow starter motor 14, even if the vehicle electrical system is only a conventional 12-volt system, with the ability to build up a sufficient rotational force prior to engaging the pulley assembly 18 to ensure a sufficient torque is supplied to start the vehicle engine 12, as will be discussed further below.

With reference to FIG. 1, the starter motor 14 is shown operably connected to the planetary gear set 16. The starter motor 14 includes a main body 20 and an output shaft 22 extending therefrom. The main body 20 is operable to receive an external signal and rotate the output shaft 22 on demand.

Figure 2:
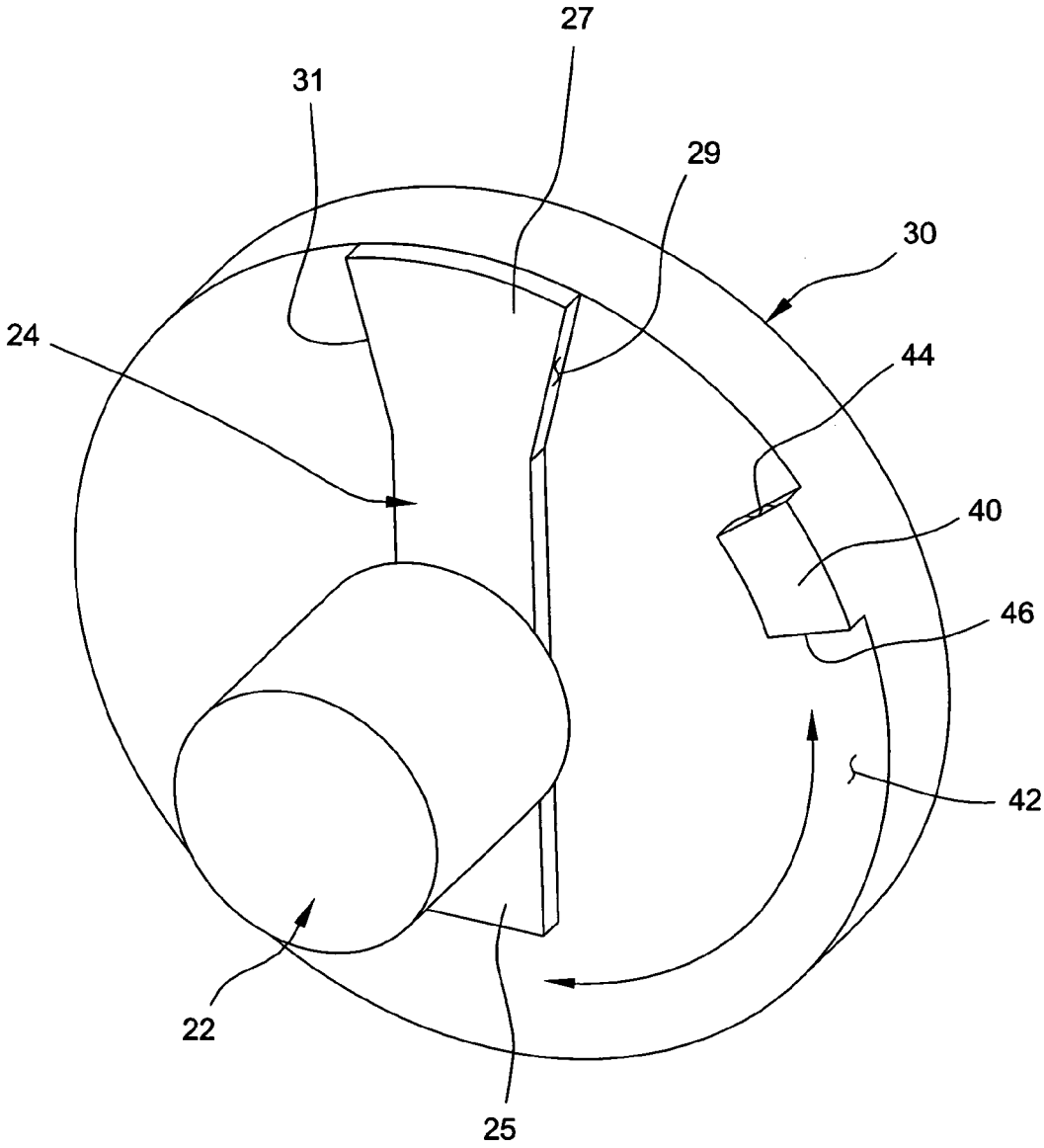
FIG. 2 is a perspective view of the starter system of FIG. 1.

A stop plate 24 is disposed between the main body 20 of the starter motor 14 and includes an elongate planar section 25 and a flared top section 27. The planar section 25 extends generally along the length of the planetary gear set 16 and terminates at a base of the top section 27, as best shown in FIG. 2. The top section 27 includes a first reaction surface 29 and a second reaction surface 31 for interaction with the planetary gear set 16, as will be discussed further below. The stop plate 24 is fixed relative to the planetary gear seat 16 and the starter motor 14 to an external structure (not shown) such that as the planetary gear set 16 and output shaft 22 rotates, the stop plate 24 is held in position relative thereto.

Figure 3:
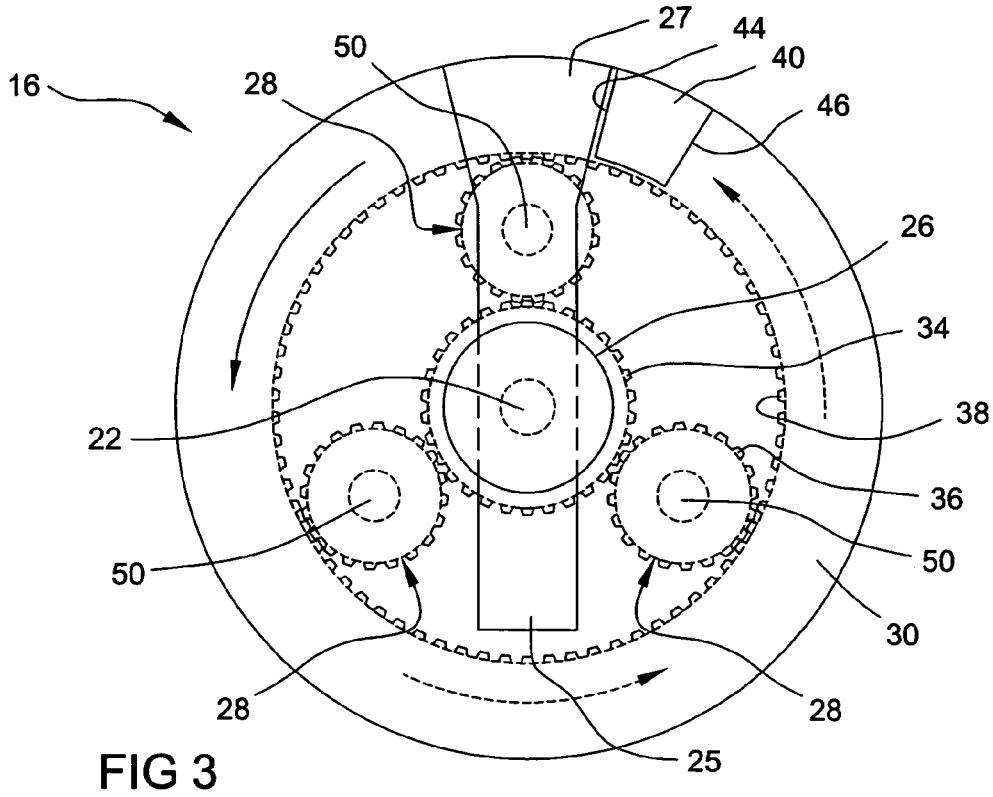
FIG. 3 is a side view of the starter system of FIG. 1 in a first position.
Figure 4:
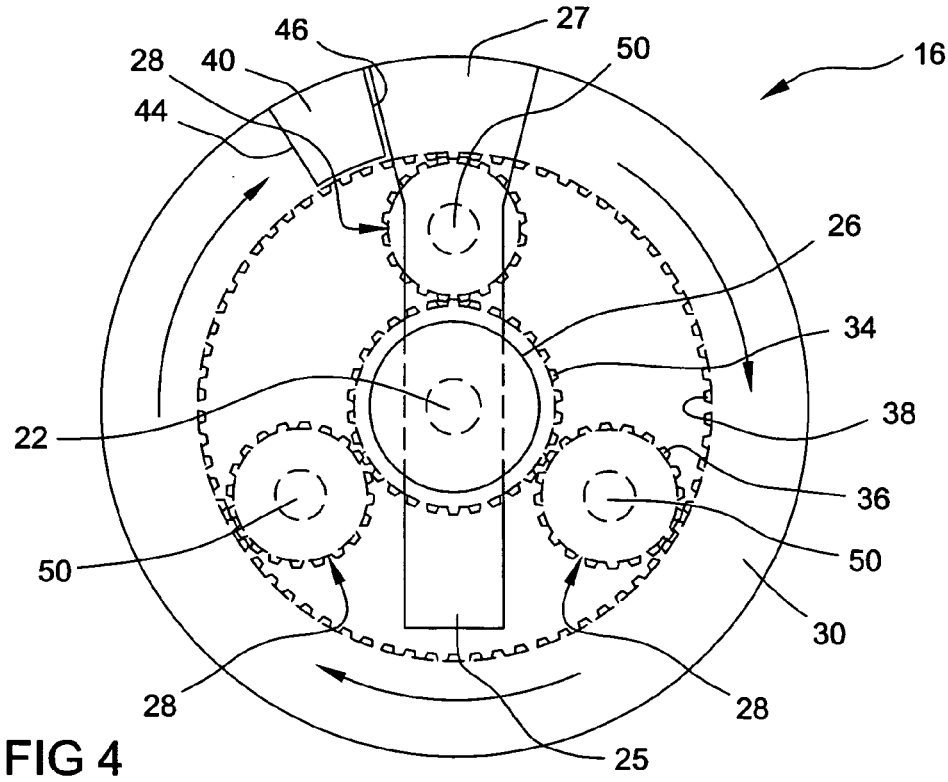
FIG. 4 is a side view of the starter system of FIG. 1 in a second position.

The planetary gear set 16 includes a sun gear 26, a plurality of pinion gears 28, a ring gear 30, and a planet carrier 32. The sun gear 26 is splined for rotation with the output shaft 22 of the starter motor 14 and includes a series of helical teeth 34. The pinion gears 28 include a series of helical teeth 36 which are in meshed engagement with the helical teeth 34 of the sun gear 26. As best shown in FIGS. 3 and 4, the pinion gears 28 are axially disposed around the sun gear 26 such that movement of the helical teeth 36 relative to the helical teeth 34 causes the pinion gears 28 to rotate around the sun gear 26.

The ring gear 30 axially surrounds the pinion gears 28 and includes an inner surface having a series of helical teeth 38 and a stop arm 40. As best shown in FIGS. 3 and 4, the helical teeth 38 of the ring gear 30 are in meshed engagement with the helical teeth 36 of the pinion gears 28. In this manner, as the helical teeth 36 of the pinion gears 28 move relative to the helical teeth 38 of the ring gear 30, one of the pinion gears 28 or the ring gear 30 will rotate relative to the sun gear 26, as will be discussed further below. The stop arm 40 extends from a first surface 42 of the ring gear 30 and includes a first engagement surface 44 and a second engagement surface 46. The first engagement surface 44 is operable to selectively engage the first engagement surface 29 of the stop plate 24 while the second engagement surface 46 is operable to selectively engage the second engagement surface 31 of the stop plate 24. While helical teeth are disclosed, it should be understood that any arrangement operable to transfer rotational force between the sun gear 26, pinion gears 28, and ring gear 30, such as a frictional engagement, is anticipated and should be considered within the scope of the present invention.

The planet carrier 32 includes a main body 48, a plurality of pinion shafts 50, and a main shaft 52 extending therefrom. The pinion shafts 50 extend from a first face 54 of the main body 48 such that the pinion shafts 50 are rotatably received by each of the pinion gears 28 such that each pinion gear 28 is journally supported by the pinion shafts 50. The main shaft 52 extends from a second face 56 of the main body 48 generally in an opposite direction to that of the pinion shafts 50.

The main body 48 is journally supported by the output shaft 22 of the starter motor 14 such that rotation of the output shaft 22 will not cause rotation of the planet carrier 32. Specifically, a bore 55 of the main body 48 receives the output shaft 22 generally at the first face 54, as best shown in FIG. 1. In this manner, the planet carrier 32 may rotate relative to the output shaft 22 of the starter motor 14 and will rotate each of the pinion gears 28 concurrently as the planet carrier 32 is rotated relative to the output shaft 22. As can be appreciated, the pinion gears 28 are operable to rotate the planet carrier 32 if a force is applied to the pinion gears 28 relative to the output shaft 22. Alternatively, the planet carrier 32 is operable to rotate the pinion gears 28 relative to the output shaft 22 if a sufficient force is applied to the planet carrier 32, as will be discussed further below.

The pulley assembly 18 is disposed between the planetary gear set 16 and the vehicle engine 12 and includes a first pulley 60, a second pulley 62, and a drive belt 64. The first pulley 60 includes a central bore 66 and a reaction surface 68 axially surrounding an exterior surface 70 of the first pulley 60. The main shaft 52 of the planet carrier 32 fixedly supports the first pulley 60, whereby the central bore 66 of the first pulley 60 matingly receives the main shaft 52 of the planet carrier 32. In this regard, rotation of either the planet carrier 32 or the first pulley 60 will cause rotation of the other of the planet carrier 32 and the first pulley 60.

The second pulley 62 is substantially the same as the first pulley 60. In this manner, a detailed description of the second pulley 62 is unnecessary. The second pulley 62 is fixedly attached to an input shaft 72 of the vehicle engine 12 at the central bore 66 and arranged to rotate therewith of the second pulley 62.

The drive belt 64 is received by the exterior surfaces 70 of the first and second pulleys 60, 62 and engages the reaction surfaces 68 of each of the first and second pulleys 60, 62. As can be appreciated, movement of the drive belt 64 along the reaction surfaces 68 of the first and second pulleys 60, 62 causes the first and second pulleys 60, 62 to concurrently rotate. In this manner, a force applied to one of the first and second pulleys 60, 62 will cause the other of the first and second pulleys 60, 62 to rotate as the force will be transmitted along the drive belt 64 between the first and second pulleys 60, 62. It should be understood that while a drive belt 64 is disclosed, any suitable load transfer element such as a drive chain and the like, is anticipated and should be considered within the scope of the present invention.

In addition to a belt driven system, it is will be understood that the planetary gear set 16 of the present invention could also be used in a direct in-line coupling arrangement. Specifically, the planetary gear set 16 could be directly coupled to the input shaft 72 of the vehicle engine 12 via main shaft 52 of planet carrier 32.

With reference to the figures, the operation of the starter system 10 will be described in detail. As previously discussed, the starter system 10 is operable to rotate an input shaft of a vehicle engine 12 in order to start the engine. To begin the start sequence, an external signal is sent to the starter motor 14, thereby causing the starter motor 14 to rotate output shaft 22 at a predetermined speed. Rotation of the output shaft 22 concurrently causes rotation of the sun gear 26 as the sun gear 26 is fixed for rotation with the output shaft 22.

As the sun gear 26 rotates relative to the main body 20 of the starter motor 14, the pinion gears 28 transfer the rotational motion from the sun gear 26 to the ring gear 30, thereby causing the ring gear 30 to rotate relative to the main body 20 of the starter motor 14. At this point, the pinion gears 28 simply transfer the rotational force from the sun gear 26 to the ring gear 30 and do not rotate relative to the main body 20. In an exemplary embodiment, the sun gear 26 and ring gear 30 can have a gear ratio of approximately 3:1 such that for every three rotations of the sun gear 26, the ring gear rotates one time. In this regard, the sun gear 26 freely rotates relative to the main body 20 of the starter motor 14 without transferring any rotational forces to the planet carrier 32, pulley system 18, or the vehicle engine 12, thereby allowing the sun gear 26 to build up kinetic energy prior to engaging the planet carrier 32.

Sufficient rotation of the ring gear 30 will cause the first engagement surface 44 of the stop arm 40 to contact the first reaction surface 29 of the stop plate 24, thereby restricting further rotation of the ring gear 30. As the ring gear 30 is abruptly stopped against the stop arm 40, the pinion gears 28 are caused to instantaneously rotate relative to the ring gear 30 due to the built-up kinetic energy of the rotating output shaft 22 and sun gear 26. In this regard, the pinion gears 28 will initially rotate with a great deal of force, thereby causing the planet carrier 32 to rotate at a high speed and with a large amount of torque.

As previously discussed, rotation of the planet carrier 32 causes concurrent rotation of the first pulley 60. Once the first pulley 60 begins to rotate, the rotational forces 60 exerted thereon are transferred to the second pulley 62 and input shaft 72 of the engine 12 via the drive belt 64. The rotational force exerted on input shaft 72 is large enough to rapidly turn the input shaft 72, thereby causing the engine 12 to fire and start very quickly due to the build up kinetic energy of the freely spinning sun gear 26 and the rapid transfer of this energy to the planet carrier 32.

As the engine 12 begins to rotate, the input shaft 72 will build up speed to a point where it is rotating at a much faster rate than the output shaft 22 of the starter motor 14. At this point, power to the output shaft 22 of the starter motor 14 is stopped, thereby causing the sun gear 26 to impart a force on the pinion gear 28 and restrict further rotation of the output shaft 22. As can be appreciated, such restriction by the sun gear 26 causes the ring gear 30 to disengage the stop arm 40 and rotate such that the first engagement surface 44 disengages the first reaction surface 29. Such rotation of the ring gear 30 is accomplished by the rotation of the pinion gears 28 relative to the sun gear 26.

As the ring gear 30 rotates away from engagement with the first reaction surface 29 of the stop arm 40, the second engagement surface 46 approaches the second reaction surface 31 of the stop arm 40. Once the ring gear 30 has sufficiently rotated away from the first reaction surface 29, the second engagement surface 46 will contact the second reaction surface 31 of the stop arm 40, thereby restricting further rotation of the ring gear 30, as best shown in FIG. 4. At this point, the rotation of the planet carrier 32 will still cause rotation of the pinion gears 28 relative to the ring gear 30. As previously discussed, the pinion gears 28 are in meshed engagement with the sun gear 26 and ring gear 30, and as such, rotation of the pinion gears 28 relative to the ring gear 30 cause concurrent rotation of the sun gear 26. In this manner, the engine 12 is operable to drive the output shaft 22 of the starter motor 14 at very high speeds without damaging the gearing of the planetary gear set 16. As the engine 12 rotates the output shaft 22, the starter motor 14 begins to act as an alternator, thereby generating electricity for use with other components associated with the vehicle (not shown).

As described, the starter system 10 of the present invention allows for the engine 12 to be stopped repeatedly, such as at traffic lights and the like, and is operable to be quickly started when movement of a vehicle is desired. In this regard, fuel can be conserved. In addition, the starter system 10 of the present invention concurrently provides a starter motor 14 with the ability to act as an alternator in response to the vehicle engine 12 rotating the output shaft 22 of the starter motor 14 at high speeds.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for starting an internal combustion engine comprising:

a torque transfer element coupled to a crankshaft of the engine and arranged to be driven by a starter motor, wherein the torque transfer element includes a gear mechanism arranged to allow said starter motor to rotate for a period of time prior to transferring rotational torque to the crankshaft to start the engine, said gear mechanism including a driven member selectively rotated by said starter motor relative to the crankshaft, said driven member being stopped to transfer kinetic energy from said gear mechanism to the crankshaft to rotate the crankshaft.

2. The apparatus of claim 1 wherein the driven member is a ring gear.

3. The apparatus of claim 2 wherein said gear mechanism comprises a planetary gear set having:

a sun gear splined for rotation with said starter motor;

at least one gear in meshed engagement with said sun gear; and a planet carrier journally supporting said pinion gear and operable to rotate with said pinion gear relative to said sun gear and said ring gear;

wherein said ring gear axially surrounds and is in meshed engagement with said pinion gear and is operable to rotate relative to said pinion pear.

4. The apparatus of claim 3 further comprising a first pulley fixed for rotation with said planet carrier, said first pulley driven by said planet carrier when said kinetic energy is transferred from said sun gear to said planet carrier in response to said ring gear being stopped.

5. The starter system of claim 4 further comprising a second pulley disposed proximate said first pulley, said first pulley operable to rotate said second pulley and said second pulley operable to rotate said first pulley.

6. The starter system of claim 5 further comprising a belt or chain disposed between said first and second pulleys, said belt or chain operable to transfer loads between said first and second pulleys.

7. The starter system of claim 5 wherein said second pulley is splined for rotation with a crankshaft of the engine.

8. The starter system of claim 3 wherein said ring gear includes an engagement arm, said engagement arm operable to selectively restrict rotation of said ring gear.

9. The starter system of claim 8 further comprising a stop plate, said stop plate operable to engage said engagement arm of said ring gear to selectively restrict movement of said ring gear and allow said sun gear to transfer said kinetic energy to said planet carrier.

10. The starter system of claim 9 wherein said stop plate includes a first and second engagement surface, said first engagement surface operable to receive said stop arm to restrict rotational movement of said ring gear when said output shaft of said starter motor is driving said ring gear and said second engagement surface operable to receive said stop arm to restrict rotational movement of said ring gear when said output shaft is driven by the engine.

11. A starter system for use with an engine comprising:

a starter motor;

an output shaft rotatably driven by said starter motor;

a sun gear fixed for rotation with said output shaft;

a plurality of pinion gears axially disposed around, and in meshed engagement with, said sun gear;

a ring gear axially surrounding, and in meshed engagement with, said plurality of pinion gears, said ring gear operable to rotate relative to said pinion gears to allow said output shaft to rotate and build up kinetic energy;

a planet carrier journally supporting said pinion gears, said planet carrier rotatable through rotation of said pinion gears relative said sun gear;

a first pulley fixed for rotation with said planet carrier;

a second pulley in mechanical communication with said first pulley, said second pulley operably engaged with a crankshaft of the engine, said second pulley operable to deliver a rotational torque from said output shaft of said starter motor to said crankshaft at a predetermined torque when said kinetic energy is transferred from said sun gear to said planet carrier in response to said ring gear being abruptly stopped.

12. The starter system of claim 11 further including a stop plate, said stop plate having a first side and a second side, and wherein said ring gear further includes a stop arm, said stop arm operable to selectively engage said stop plate on said first side and restrict further rotation of said ring gear when said ring gear is sufficiently rotated by said pinion gears to deliver a predetermined torque to the engine via said planet carrier and said first and second pulleys.

13. The starter system of claim 12 wherein said stop arm is operable to engage said stop plate on said second side to restrict further rotation of said ring gear when said second pulley drives the output shaft of said starter via said first pulley, said pinion gears, and said sun gear.

14. The starter system of claim 13 wherein said starter motor is operable to generate electrical energy when said stop arm is engaged with said second side of said stop plate and said output shaft of said starter motor is driven by said second pulley.

15. A method for starting an engine comprising:

coupling a planetary gear set to a starter motor;

allowing said starter motor to rotate a driven member to accumulate kinetic energy without concurrently driving an output of said planetary gear set;

transferring said kinetic energy from said starter motor to said output of said planetary gear set by stopping said driven member;

driving a crankshaft of the engine with said output of said planetary gear set; and rotating said crankshaft in response to rotation of said output of said planetary gear set to thereby start the engine.

16. The method of claim 15 further comprising fixing a first pulley for rotation with said output of said planetary gear set and fixing a second pulley for rotation with said crankshaft said first and second pulleys operable to transmit rotational forces therebetween.

17. The method of claim 16 further comprising driving said second pulley by the engine when a rotational speed of said crankshaft is greater than a rotational speed of said starter motor.

18. The method of claim 17 further comprising driving said first pulley, said planetary gear set, and said output shaft of said starter motor by said second pulley when the rotational speed of said crankshaft is greater than the rotational speed of said starter motor.

19. The method of claim 18 further comprising generating electrical energy through rotation of said starter motor when said starter motor is driven by said second pulley.

20. The method of claim 15 further comprising driving said planetary gear set with the engine to rotate said starter motor when said starter motor is not engaged to start the engine.

21. The method of claim 15 further comprising providing a stop plate, said stop plate operable to engage said driven member and transfer said kinetic energy from said starter motor to said output of said planetary gear set.

* * * * *